United States Patent [19]

Ekelund

[11] 4,298,122

[45] Nov. 3, 1981

[54] METHOD AND APPARATUS FOR APPLYING WARP THREADS TO HAND LOOMS

[76] Inventor: Christer Ekelund, Bjorkelycka, S-510 10 Horred, Sweden

[21] Appl. No.: 58,930

[22] Filed: Jul. 19, 1979

[30] Foreign Application Priority Data

Jul. 25, 1978 [DE] Fed. Rep. of Germany ... 7822192[U]

[51] Int. Cl.[3] ..... B65D 85/66

[52] U.S. Cl. ..... 206/389; 206/227; 206/825; 28/190; 242/125.1

[58] Field of Search ..... 28/190, 192, 196; 242/125.1, 125.2; 206/825, 417, 389, 390, 391, 388, 49, 227

[56] References Cited

U.S. PATENT DOCUMENTS

| | | | |
|---|---|---|---|
| 1,907,468 | 5/1933 | Thompson . | |
| 2,681,703 | 6/1954 | Kuenn et al. | 206/417 |
| 3,190,443 | 6/1965 | Kingsley | 206/389 |
| 3,283,892 | 11/1966 | Rosen | 206/392 |
| 3,395,789 | 8/1968 | O'Berry et al. | 206/389 |
| 3,592,340 | 7/1971 | Hozy | 206/389 |
| 3,693,906 | 9/1972 | Robinson | 206/389 |

FOREIGN PATENT DOCUMENTS

| | | |
|---|---|---|
| 429147 | 10/1926 | Fed. Rep. of Germany . |
| 123415 | 5/1948 | Sweden . |

*Primary Examiner*—Joseph Man-Fu Moy
*Attorney, Agent, or Firm*—Dann, Dorfman, Herrell and Skillman

[57] ABSTRACT

A yarn package used to thread up a hand loom comprises an elongated support 41, such as a cardboard tube, on which a full complement of warp threads 27 are wound. At their inner ends, the threads are secured to the support by an adhesive strip 43 extending along the length of the support and spaced about 15 cm from the free ends of the warp threads. The inner ends of the warp threads are held down against the support by a safety tape 43*a.* The outer ends of the warp threads 27 are secured together in side-by-side relation by a self-adhesive tape 45 extending lengthwise of the support. The tape is releasably held on the underlying convolutions of the warp threads by tabs 46. The tape 45 is used to anchor the warp threads 27 on the warp beam of a hand loom.

In use, the tape 25 is transferred to the warp beam and the warp threads 27 are wound onto the beam from the package. Before the package is completely unwound, it is moved through the loom to a point behind the heddles and reed, and the inner ends of the warp threads are threaded into the heddles and reed.

FIGS. 1*a* and 1*b* best illustrate the package.

6 Claims, 7 Drawing Figures

METHOD AND APPARATUS FOR APPLYING WARP THREADS TO HAND LOOMS

The present invention relates to hand looms and has particular application to a method and apparatus for supplying warp threads, mounting them on the warp beam and threading the threads into the hand loom.

Prior to the present invention, warp threads for use in hand looms have been supplied in the form of individual threads which must be cut to suitable length for use in the hand loom and must be previously combed and drawn in reverse through the reed while threading up the loom. Also, the warp threads must be tied by the weaver tightly onto the warp beam in a tedious and time-consuming manner.

The present invention provides a novel apparatus and method for supplying warp threads to the hand loom in a manner to facilitate the threading up of the loom without the drawbacks of the prior art methods.

In particular, the present invention provides a self-contained package which comprises roller-like support on which the warp threads are wound for transfer onto the warp beam of the hand loom, all of the warp threads being secured in a highly efficient and effective manner, the roller-like support being used to facilitate the threading of the warp threads through the reed and harnesses.

The method of the present invention is performed by supplying all of the warp threads on a single package which is designed to facilitate the threading up of the hand loom. The warp threads are wound on the package in a sequence corresponding to their sequence in the hand loom and are unwound from the package onto the warp beam. The opposite ends of the warp threads are retained on the package in such a manner as to facilitate threading the threads into the harnesses and reed over the breast beam to the cloth takeup roll.

All of the objects of the invention are more fully set forth hereinafter with reference to the accompanying drawing, wherein:

FIGS. 1*a* and 1*b* are perspective views of the warp thread package apparatus in accordance with the invention in loaded and unloaded conditions respectively;

Figure 4:
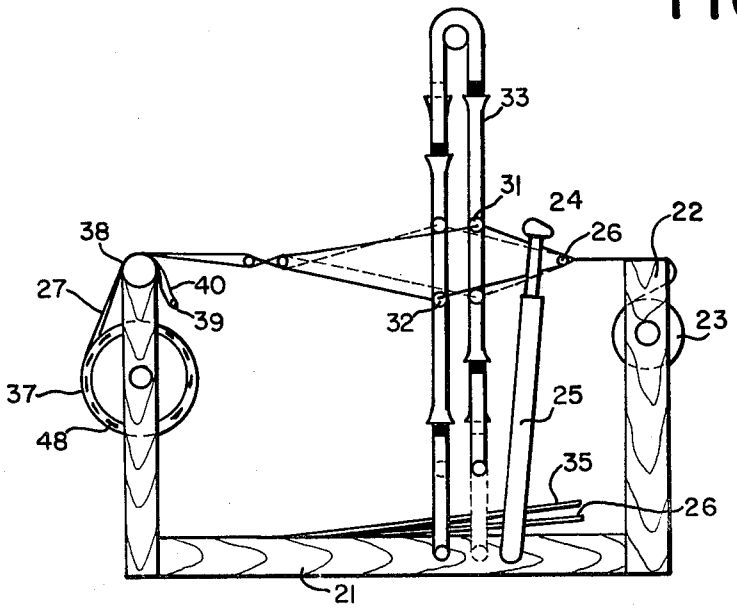
Figure 2:
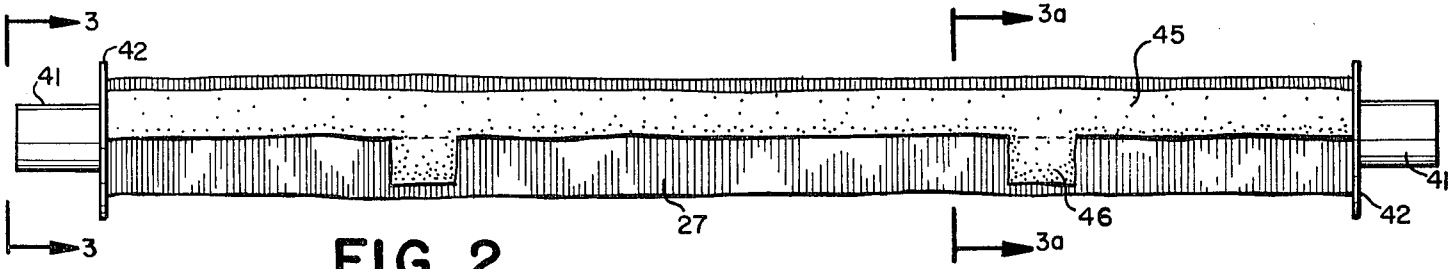
FIG. 2 is a plan view of the apparatus of FIG. 1 loaded with warp threads in accordance with the invention.
Figure 3B:
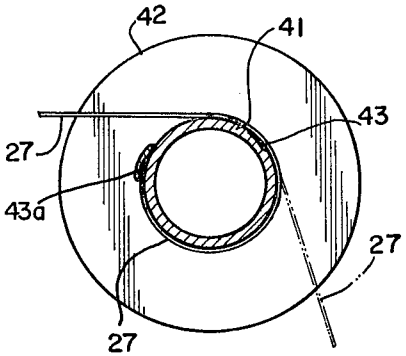
FIG. 3 is an end view of the apparatus shown in FIG. 2.
Figure 3A:
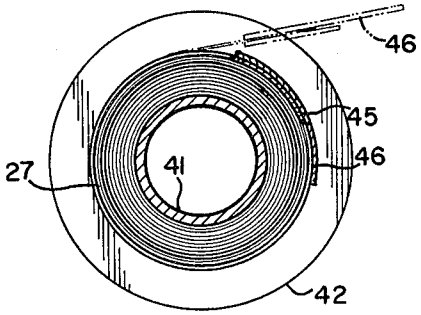
Figure 3:
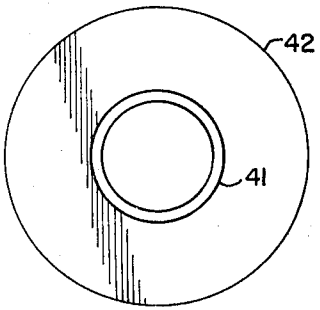

FIG. 3*a* is a sectional view of the apparatus as shown on the line 3*a*—3*a* of FIG. 2;

FIG. 3*b* is a view similar to FIG. 3*a* showing the apparatus after unloading of the package onto the warp beam; and FIG. 4 is a diagrammatic transverse sectional view of a hand loom after being threaded up in accordance with the present invention.

The hand loom diagrammatically illustrated in FIG. 4 may be of conventional construction including a loom frame 21 having a breast beam 22 extending across the front of the frame, over which the finished cloth is drawn to a cloth takeup roll 23. Rearwardly of the breast beam 22, the reed 24 is mounted on the lay 25 for beating up the weft or filling which is inserted into the sheds formed by the warp threads by means of a hand-manipulated shuttle 26. The warp threads 27 are threaded through heddle eyes 31 and 32 in heddle frames 33 and 34 which are manipulated by treadles 35 and 36 at the bottom of the loom frame. The warp threads 27 are drawn off from a warp beam 37 at the rear of the frame over a whip roll 38 by a toothed ratchet mechanism (not shown) assisted by a weighted beam bar 39 which is inserted in beam cords 40 extending over the whip roll 38 and around the warp beam 37.

Figure 1A:
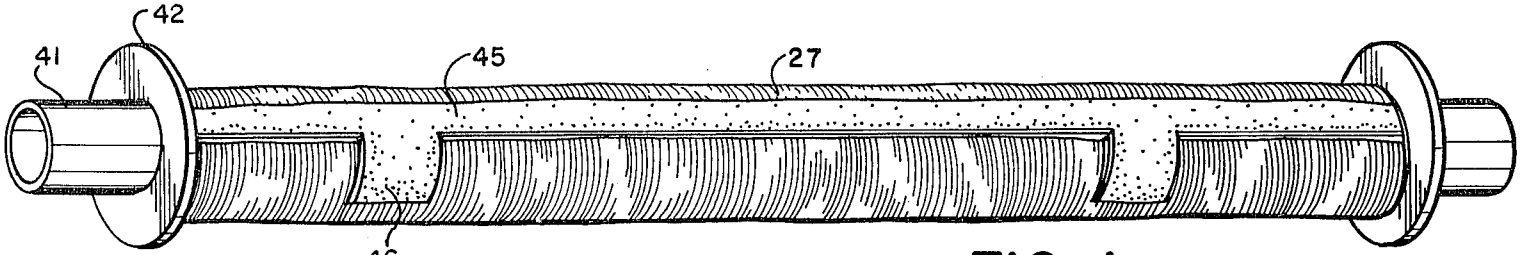
Figure 1B:
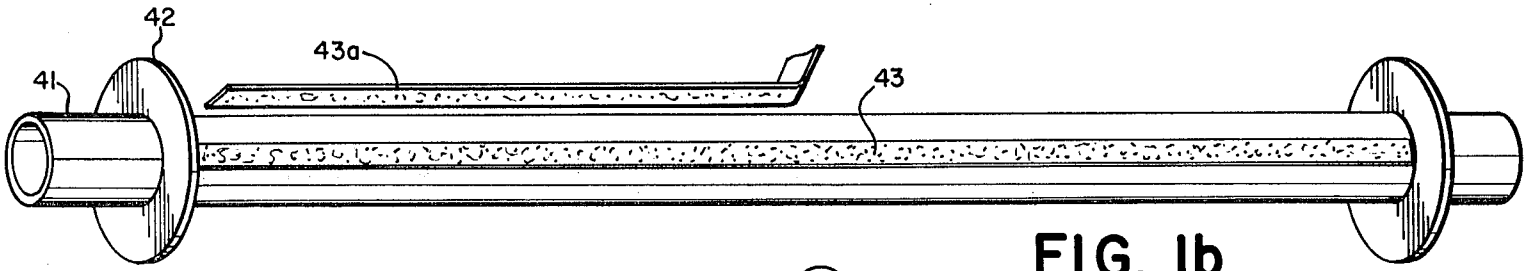

In accordance with the invention, novel apparatus is provided to facilitate the installation of the warp threads on the warp beam. To this end, as shown in the drawings, the threading apparatus in accordance with the invention comprises an elongated support, for example a tubular carboard cylinder 41 which in the present instance has spaced inwardly from its ends, for example a hand-width, a pair of disc-shaped flanges 42 to guide and support the warp threads which are wound onto the tube 41 between the flanges 42,42. The warp threads 27 are positioned on the cylindrical support 41 in the proper sequence corresponding to the sequence of threads on the warp beam 37 so as to facilitate the direct transfer of the warp threads from the support tube 41 onto the warp beam. As shown in FIG. 1*b*, the cylindrical support has a self-adhesive strip 43 extending along the length thereof. The strip 43 may be in the form of a stripe of pressure-sensitive adhesive applied to the cylindrical support 41, or it may be a double-faced adhesive tape which is secured to the support to provide an exposed adhesive strip, as shown in FIG. 1*b*. The adhesive strip 43 serves to anchor the ends of the entire complement of warp threads on the support. Preferably, the threads are anchored to the adhesive strip inwardly from their ends, for example 15 cm, so that the free ends of the warp threads all extend in the same direction beyond the adhesive strip. In order to prevent entanglement, the free ends of the warp threads may be held down on the support 41 by a second adhesive tape 43*a* which may be designated a safety strip.

The threads 27 are then wound circumferentially on the cylindrical support 41, side by side, to provide a package containing all of the warp threads to be installed in the hand loom. The warp threads 27 are wound around the cylindrical support 41 a sufficient number of times to provide the desired length of the warp threads for use in the hand loom. The warp threads 27 are shown wound on the cylindrical support 41 in FIG. 1*a*. When the necessary lengths have been wound on the support 41, the opposite ends of the threads are fastened by a self-adhesive transfer tape 45 having a length corresponding to the length of the support. As shown in FIG. 1*a*, the tape 45 preferably has two or more fastening tabs 46 projecting circumferentially of the support which are used to facilitate fastening of the warp threads to the warp beam. The self-adhesive tape 45 may be folded on itself to entrap the ends of the warp threads between the folds thereof, the tabs 46 being formed by cutting away a portion of the tape prior to folding on itself. In this way, the adhesive face of the tape 45 in the cutaway portions is exposed on the underside of the tabs 46 to releasably anchor the tape 45 to the underlying warp threads 27 on the support 41. Alternatively to folding over the tape 45, the threads may be held between separate complementary strips.

By this invention, the threads may be wound on the tube under the desired tension and the tape 45 enables the threads to be held in the package under a uniform tension.

When the warp threads 27 are wound on the support 41 and are held down by the adhesive strip, when the warp threads are wound on the support 41 and are retained in place by the adhesive transfer tape 45, the assembly comprises a complete package of the warps which are selected for the particular fabric to be woven on the loom. This package may be handled without damage to the warp threads and may be retained intact until it is desired to install the warp threads on the loom.

When installing the warp threads onto the loom, it is a relatively simple operation which may be undertaken by two relatively unskilled people. When it is desired to install the threads, the package is positioned alongside the warp beam, for example on a suitable table or other support. The tape 45 is then released from the underlying warp threads while still retaining the ends of the individual threads firmly secured thereto. The tape is then tacked onto the warp beam, thereby rapidly and securely anchoring all of the warp threads to the warp beam in proper sequence. To supplement the adhesive attachment of the tape 45 to the warp beam, tacking pins may be passed through the tape into the beam, for example at 10 cm intervals. The transfer tape 45 enables the warp threads to be more uniformly tensioned as they are transformed to the warp beam, especially when compared to the uneven tension which arises when the warp threads are tied onto the warp beam. Then, the support 41 may be fastened to the loom, for example by insertion of a handle or the like and tying tightly to cords of the yarn beam. Then the ratchet can be drawn off from the toothed wheel and the beam cords can be withdrawn with the handle and the support to such an extent that this extends over the whip roll and can be placed thereover. Then the beam bar is placed on the handle and so measured that it comes to the center, whereupon it is tied tightly with a strong cord approximately once every 20 cm of warp thread.

Then the warp beam may be rotated several turns to start the warp threads wrapping around the beam. The warp beam is rotated by releasing the ratchet mechanism and rotating the beam counter-directionally so as to wind up the warp threads onto the beam. The beam cords also extend around the warp beam and in order to protect the warp threads from the beam cords, the beam bar 39 is passed around the warp beam inside of the warp threads. During the entire first revolution, laths or slats 48 are placed between the beam cords and the warp threads at suitable intervals approximately one bar width. After completion of the first revolution with the laths 48, two or three laths are installed closely side by side. In order to obtain a firm and uniform winding of the warp threads on the warp beam, approximately four laths should be inserted upon every fourth revolution. As the warp threads are wound onto the beam, the package is held to maintain the warp threads firmly tensioned. The package is passed over the whip roll 38 and markings are made on the whip roll corresponding to the warp threads so that it is easier to control the winding up of the warp threads 27 laterally on the beam 37.

When the bulk of the warp threads are wound onto the warp beam from the package, the heddles 31 and 32 are moved with the heddle frames 33 and 34 from their normal position rearwardly from the lay in the loom to a position as close as possible to the lay 25 and reed 24. The support 41 is then moved through the loom to a position immediately behind the heddles so that the free ends of the warp threads are all directed downwardly. The safety strip 43*a* is then gradually peeled from the ends of the warp threads to permit the ends to be drawn in through the heddles and the reed one-by-one across the width of the loom. As the threads are drawn in through the heddles and the reed, they may be stripped from the adhesive strip 43 and passed forwardly onto the takeup cloth roll over the breast beam. In this fashion, the support maintains the warp threads in proper position for threading through the heddles 31 and 32 and the reed 24 so as to simplify the threading-in operation. When all of the warp threads are threaded and secured to the takeup roll 23, the support 41 may be removed from the loom.

The support may be used advantageously without a lease in front of the heddles. In the case of a two-shaft weave, a lease can be taken and lease bars may be inserted, if so desired.

While a particular embodiment of the present invention has been herein illustrated and described, it is not intended to limit the invention to such disclosure but changes and modifications may be made within the scope of the following claims.

I claim:

1. A package of warp threads for installation on a hand loom having heddles and a warp beam comprising a series of warp threads, a support consisting of a disposable cylinder, an anchor strip extending along the length of said support for releasably anchoring said warp threads to the support in a given sequence corresponding to the sequence of the threads in said hand loom, with the inner ends of the warp threads all projecting beyond the anchor strip to provide free ends to be drawn through the heddles, the warp threads all being wound circumferentially of said support to protect said free ends and to provide a given length of warp threads thereon, disc-like flanges spaced inwardly from the ends of said support for guiding and limiting the warp threads adjacent thereto, the ends of the support beyond said flanges forming hand holds for handling the package without damage to the threads during installation, an adhesive transfer tape secured to the outer ends of the warp threads to maintain said threads in said desired sequence for attachment to the warp beam, said tape extending longitudinally of the support and holding the warp threads on the support, said transfer tape being releasably anchored to the underlying warp threads to provide a package capable of being handled without disruption of the warp threads therein, said tape being displaceable with the outer ends of the warp threads secured thereto from said underlying warp threads onto the warp beam of the hand loom, and operable to be secured to said beam to anchor all of said warp threads thereon.

2. A warp thread package according to claim 1 including an adhesive tape anchoring the free inner ends of the warp threads onto said support at a spaced distance from said anchor strip.

3. Apparatus according to claim 1 wherein said disposable cylinder is hollow.

4. A package according to claim 1 wherein said anchor strip comprises a double-faced self-adhesive strip running longitudinally of said support and adhesively securing said threads to said support.

5. A package of warp threads according to claim 1 wherein said transfer tape includes anchor tabs at spaced locations along its length to facilitate anchoring of said transfer tape to the warp beam.

6. A package of warp threads according to claim 5 wherein said transfer tape comprises two layers of self-adhesive tape retaining the outer ends of the warp threads therebetween.

* * * * *